US010566705B2

(12) United States Patent
Washio et al.

(10) Patent No.: US 10,566,705 B2
(45) Date of Patent: Feb. 18, 2020

(54) METHOD FOR MANUFACTURING ELECTRICAL CONNECTION ASSEMBLY

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuhiro Washio, Mie (JP); Yasuo Omori, Mie (JP); Toshio Shimizu, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/316,439

(22) PCT Filed: Jun. 22, 2017

(86) PCT No.: PCT/JP2017/022978
§ 371 (c)(1),
(2) Date: Jan. 9, 2019

(87) PCT Pub. No.: WO2018/012239
PCT Pub. Date: Jan. 18, 2018

(65) Prior Publication Data

US 2019/0296451 A1 Sep. 26, 2019

(30) Foreign Application Priority Data

Jul. 12, 2016 (JP) ..... 2016-137286

(51) Int. Cl.
*H01R 4/02* (2006.01)
*H01R 13/516* (2006.01)
(Continued)

(52) U.S. Cl.
CPC ..... *H01R 4/02* (2013.01); *H01R 13/46* (2013.01); *H01R 13/516* (2013.01); *H01R 43/00* (2013.01);
(Continued)

(58) Field of Classification Search
CPC .... H01R 12/77; H01R 12/771; H01R 12/772; H01R 12/774; H01R 12/777;
(Continued)

(56) References Cited

U.S. PATENT DOCUMENTS 4,834,668 A * 5/1989 Markwardt ..... H01R 24/20 439/392

FOREIGN PATENT DOCUMENTS

| | | |
|---|---|---|
| JP | 1-80768 | 5/1989 |
| JP | 2008-147180 | 6/2008 |
| JP | 2010-146939 | 7/2010 |

OTHER PUBLICATIONS

International Search Report dated Sep. 12, 2017.

* cited by examiner

*Primary Examiner* — Ross N Gushi
(74) *Attorney, Agent, or Firm* — Gerald E. Hespos; Michael J. Porco; Matthew T. Hespos

(57) ABSTRACT

A method for manufacturing an electrical connection assembly includes a connector preparing step of preparing a connector (CN), in which each of plural terminals (20) has a conductor connection surface (27*a*) exposed outside an insulating housing (30). A connecting step of connects parts of conductors and the conductor connection surfaces (27*a*) corresponding thereto while tension is applied to a wiring material (10) by holding the wiring material (10) including the conductors arrayed at intervals from each other in an array direction at holding positions separated from each other in a longitudinal direction of the wiring material. A
(Continued)

cutting step sandwiches and cuts the wiring material (10) by two cutting tools (62, 65) at a cutting position between one of the holding positions and the parts to be connected with the wiring material (10) kept held after the completion of the connecting step.

6 Claims, 15 Drawing Sheets

(51) Int. Cl.
*H01R 43/02* (2006.01)
*H01R 13/46* (2006.01)
*H01R 43/00* (2006.01)

(52) U.S. Cl.
CPC ..... *H01R 43/02* (2013.01); *H01R 43/0207* (2013.01); *H01R 43/0214* (2013.01); *H01R 43/0221* (2013.01); *H01R 43/0263* (2013.01)

(58) Field of Classification Search
CPC ..... H01R 12/778; H01R 43/0221; H01R 43/0263; H01R 43/01
See application file for complete search history.

METHOD FOR MANUFACTURING ELECTRICAL CONNECTION ASSEMBLY

BACKGROUND

Field of the Invention

The invention relates to a method for manufacturing an electrical connection assembly used in an automotive vehicle or the like and including a wiring material and a connector.

Related Art

A wiring material used in an automotive vehicle or the like has conductors arrayed in a direction perpendicular to an axial direction of the conductors. The conductors are connected to terminals of a connector so that the conductors included in the wiring material can be connected to another circuit.

Japanese Unexamined Patent Publication No. 2010-146939 discloses a method for connecting conductors arrayed as described above and a connector that has terminals corresponding to the respective conductors and a housing. The method disclosed in Japanese Unexamined Patent Publication No. 2010-146939 removes an insulation coating at an end of each of plural wires to expose the conductor and the wires are held in parts near tips of the conductors so that the tips of the conductors are aligned in a row. The connector to be connected to each wire includes the terminals in the form of thin plates corresponding to the respective wires and the housing for holding the terminals. The housing has a flat terminal array surface and holds the terminals such that the terminals are exposed on the terminal array surface. Cream solder is set on surfaces of the terminals in advance, and the tips of the conductors and the surfaces of the terminals are soldered by pressing the cream solder against the surfaces of the terminals and heating the cream solder by a heater with the tips of the respective conductors of the wires positioned on the cream solder.

However, in the above method, the end of the wire and each terminal are soldered in a state where the end of each wire is a free end part, i.e. a state where no tension is applied to the end at all by holding each wire at a position near the end of the wire. Thus, a relative position of the end of each wire with respect to each terminal is unstable, and this unstable positioning hinders connection reliability improvement between the terminal and the wire.

The invention aims to provide a method for manufacturing an electrical connection assembly with a wiring material including conductors and a connector, where the method ensures high connection reliability by stabilizing relative positions of the conductors and terminals included in the connector.

SUMMARY

The invention relates to a method for manufacturing an electrical connection assembly that has a wiring material and a connector. The wiring material includes conductors. The connector includes terminals respectively corresponding to the conductors and an insulating housing for collectively holding the terminals. The conductors are connected conductively to the respective terminals while being arranged in an array direction perpendicular to a longitudinal direction of the conductors. The method includes a connector preparing step of preparing a connector, in which each of the terminals has a conductor connection surface exposed outside the insulating housing from a surface of the insulating housing and the insulating housing holds the terminals with the conductor connection surfaces arranged in the array direction at the same intervals as the intervals of the conductors in the array direction. The method also includes a connecting step of electrically connecting parts of the conductors of the wiring material located between holding positions separated from each other in a longitudinal direction of the wiring material and the conductor connection surfaces corresponding thereto by bringing these parts into contact with each other while applying tension to the wiring material by holding the wiring material at the holding positions with the conductors arrayed at intervals from each other in the array direction. The method further includes a cutting step of sandwiching the wiring material in a cutting direction perpendicular to each of the longitudinal direction of the wiring material and the array direction and cutting the wiring material by two cutting tools at a cutting position between one of the holding positions and the parts to be connected with the wiring material kept held after the completion of the connecting step.

DETAILED DESCRIPTION

Preferred embodiments of the invention are described with reference to the drawings.

FIGS. 1 to 10 show a manufacturing method according to a first embodiment of the invention and an electrical connection assembly manufactured by this method. The electrical connection assembly includes wires 10 constituting a wiring material, and a connector CN for connecting the wires 10 to another connector.

Figure 6:
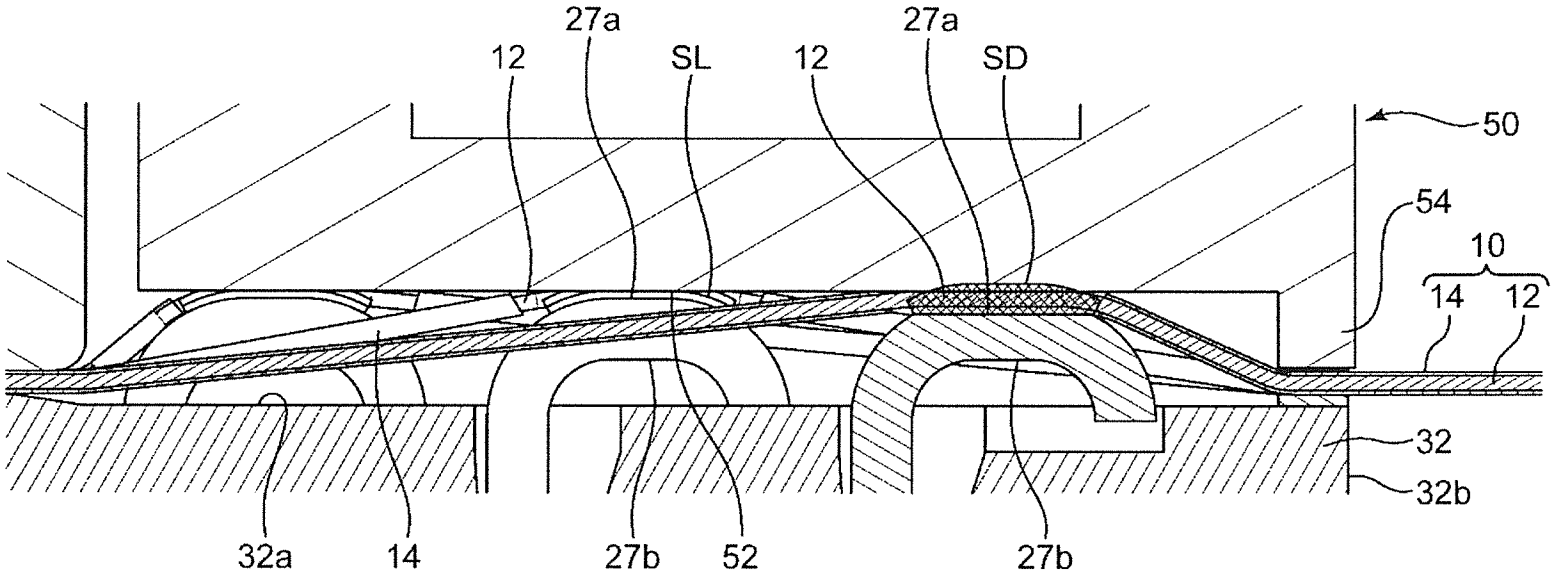
FIG. 6 is an enlarged view of an area enclosed by a frame line VI in FIG. 5.
Figure 7:
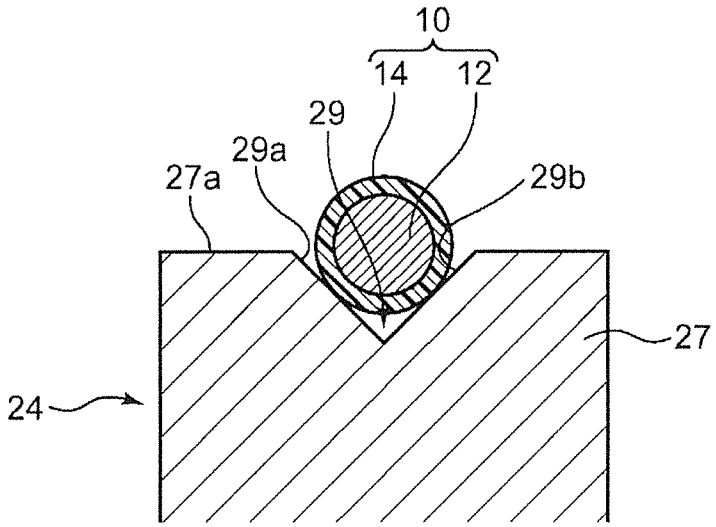
FIG. 7 is a front view in section showing a state where the wire is set in a recessed groove of the terminal.
Figure 8:
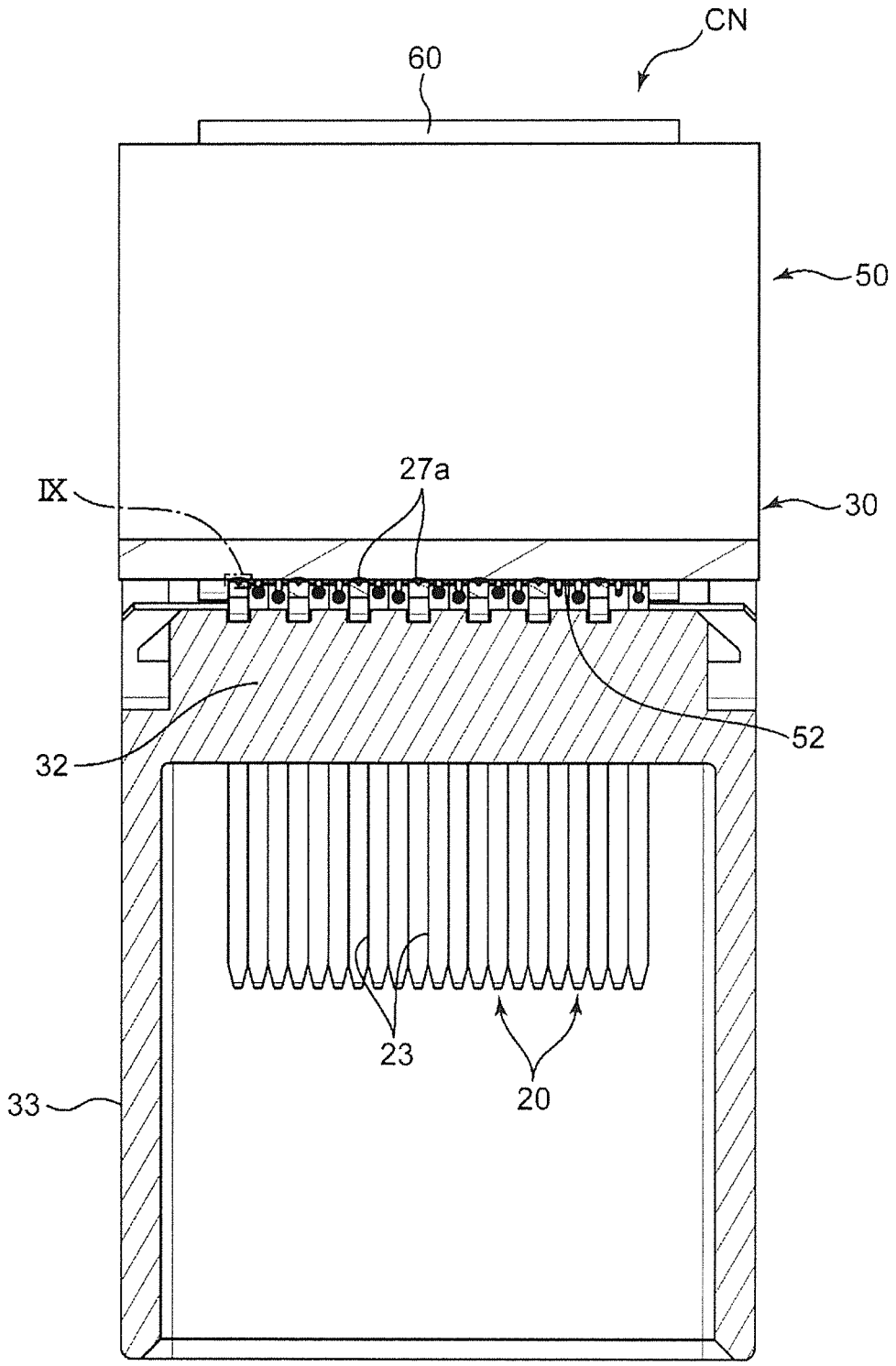
FIG. 8 is a front view in section showing the step shown in FIG. 4.
Figure 9:
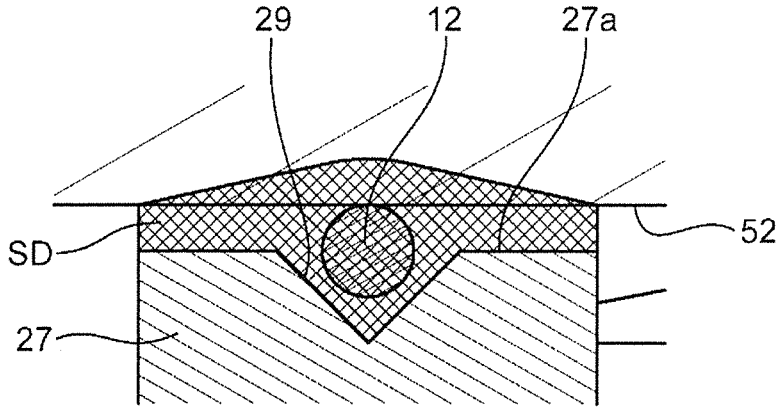
FIG. 9 is an enlarged view of an area enclosed by a frame line IX in FIG. 8.

Each of the plurality of wires 10 includes a conductor 12 and an insulation coating 14 for covering the conductor 12, as shown in FIGS. 6 and 7. The wires 10 are connected to the connector CN while being arranged at intervals in parallel to each other in an array direction perpendicular to a longitudinal direction thereof.

The connector CN includes terminals 20 respectively corresponding to the wires 10 and an insulating housing 30 for collectively holding the terminals 20.

Figure 5:
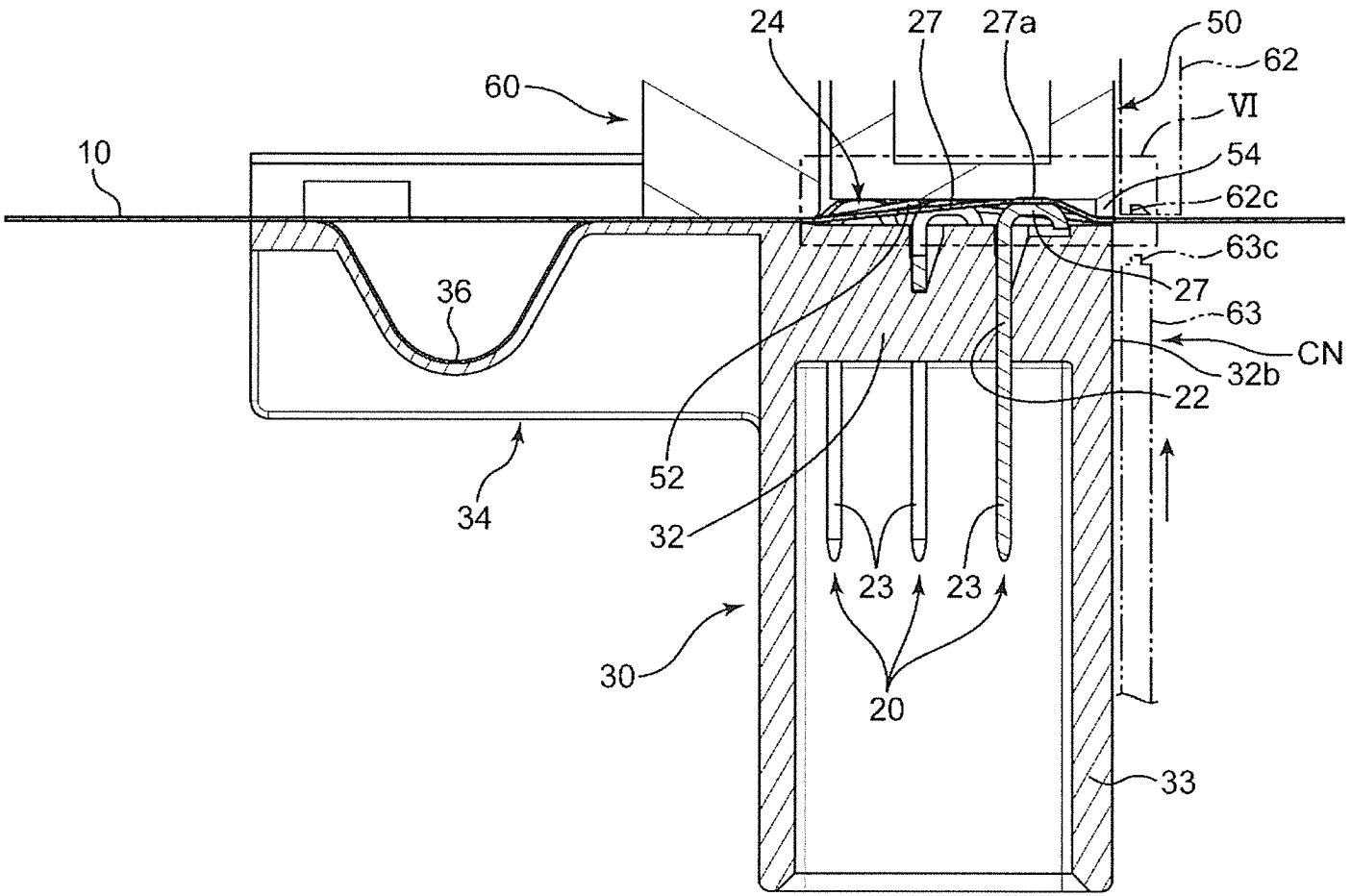
FIG. 5 is a side view in section showing the step shown in FIG. 4.

Each of the terminals 20 according to this embodiment is a male terminal formed of a single long metal plate and includes a held portion 22, an electrical contact portion 23 and an outward projecting portion 24, as shown in FIG. 5. The held portion 22 is to be held in the insulating housing 30 as described later. The electrical contact portion 23 is a male contact portion in this embodiment and is shaped to fit into a female contact portion of a mating terminal. Specifically, the electrical contact portion 23 is shaped to extend straight in a first direction to be described later from the held portion 22. The outward projecting portion 24 projects from the held portion 22 toward a side opposite to the electrical contact portion 23 and is to be connected to the corresponding wire 10. The outward projecting portion 24 is described in detail later.

The insulating housing 30 is molded of an insulating material such as synthetic resin and integrally includes a terminal holding portion 32, a receptacle 33 and a wire holding portion 34.

The terminal holding portion 32 holds the held portion 22 of each of the terminals 20, and is in the form of a block in this embodiment. The terminal holding portion 32 collectively holds the terminals 20 arrayed in the array direction to enable the wires 10 arranged at intervals in the array direction to be connected conductively to the outward projecting portions 24 of the terminals 20.

Specifically, the terminal holding portion 32 holds the held portions 22 of the terminals 20 with the respective terminals 20 penetrating through the terminal holding portions 32 in a direction parallel to the first direction. The first direction is a direction perpendicular to both a longitudinal direction of the wires 10 and the array direction with the wires 10 connected to the terminals 20, and an upward direction in an orientation shown in FIG. 5. That is, parts of the terminals 20 including the held portions 22 penetrate through the terminal holding portion 32 in a vertical direction in the orientation shown in FIG. 5. The held portions 22 may be fixed to the terminal holding portion 32 by being press-fit into through holes provided in the terminal holding portion 32 or by adhesive or the like.

The electrical contact portion 23 of each terminal 20 extends in a direction (down in the orientation shown in FIG. 5) opposite to the first direction from the held portion 22 with the held portion 22 held in the terminal holding portion 32 as described above, and is fit into the female contact portion of the mating terminal in this direction. The receptacle 33 is connected integrally to the terminal holding portion 32 and has a tubular shape to surround the electrical contact portions 23 on an outer side in a direction perpendicular to an axial direction (vertical direction in the orientation shown in FIG. 5) of the electrical contact portions 23.

The outward projecting portion 24 of each terminal 20 integrally includes a first projecting portion 26, a second projecting portion 27 and a third projecting portion 28 as shown in FIG. 6. The first projecting portion 26 projects in the first direction (up in FIG. 6) from an upper surface 32*a*, which is a surface of the terminal holding portion 32. The second projecting portion 27 extends from the first projecting portion 26 in a second direction (direction parallel to the upper surface 32*a* in this embodiment; lateral direction in FIG. 6) closer to a direction parallel to the surface of the terminal holding portion 32 than the first direction and perpendicular to the array direction. The third projecting portion 28 extends in a direction (down in FIG. 6) opposite to the first direction from a right end part in FIG. 6 on a side opposite to the first projecting portion 26.

In the first embodiment, the first projecting portion 26 has a bent shape to approach gradually from the first direction to the second direction. Similarly, the third projecting portion 28 has a bent shape to approach the direction opposite to the first direction (down in FIG. 6) extending away from the second projecting portion 27.

An outer side surface of the second projecting portion 27 (upper surface in FIG. 6) on a side opposite to the upper surface 32*a* of the terminal holding portion 32 constitutes a conductor connection surface 27*a*. The conductor connection surface 27*a* is connectable to a part to be connected, which is a specific part of the conductor 12 of the wire 10, by soldering with the part to be connected placed thereon. The conductor connection surface 27*a* according to this embodiment extends parallel to the upper surface 32*a* of the terminal holding portion 32.

Further, in the first embodiment, the conductor connection surface 27*a* is formed with a groove 29 as shown in FIG. 7. This groove 29 is a recess extending in the longitudinal direction of the wire 10, and is shaped to restrict a displacement of the wire 10 in the array direction (width direction of the terminal 20; lateral direction in FIG. 7) by receiving the wire 10 fit therein. This groove 29 has two positioning inclined surfaces 29*a*, 29*b* inclined toward each other in a direction parallel to the array direction as extending toward a bottom part of the groove 29.

A projecting dimension of the first projecting portion 26 from the upper surface 32*a* of the terminal holding portion 32 is set to position the second projecting portion 27 such that the second projecting portion 27 extends in the second direction at a position where the surface of the second projecting portion 27 facing the upper surface 32*a* of the terminal holding portion 32, i.e. an inner side surface 27*b* (lower surface in FIG. 6) on a side opposite to the conductor connection surface 27*a* is separated outward (up in FIG. 6) from the surface of the terminal holding portion 32.

In the first embodiment, outward projecting dimensions of the outward projecting portions 24 from the upper surface 32*a* of the terminal holding portion 32 are equal. That is, the terminal holding portion 32 holds the terminals 20 such that the conductor connection surfaces 27*a* of the respective terminals 20 are on the same plane. As just described, the conductor connection surfaces 27*a* of the terminals 20 according to the first embodiment are equivalent to a planar array of terminals arranged on a common plane.

Further, the terminal holding portion 32 of the first embodiment holds the held portions 22 of the terminals 20 such that the conductor connection surfaces 27*a* of the terminals 20 are arranged at intervals in the array direction, and the conductor connection surfaces 27*a* of the terminals 20 adjacent in the array direction are shifted from each other in the longitudinal direction (vertical direction of FIG. 2) of the wires 10.

The wire holding portion 34 extends in a direction parallel to the second direction from the terminal holding portion 32 and holds the wires 10 in such an orientation that the wires 10 extend along the second direction. The wire holding portion 34 according to the first embodiment includes parallel wire holding grooves 34*a* corresponding to the respective wires 10 and supports the wires 10 from below with the wires 10 fit in the wire holding grooves 34.

Figure 10:
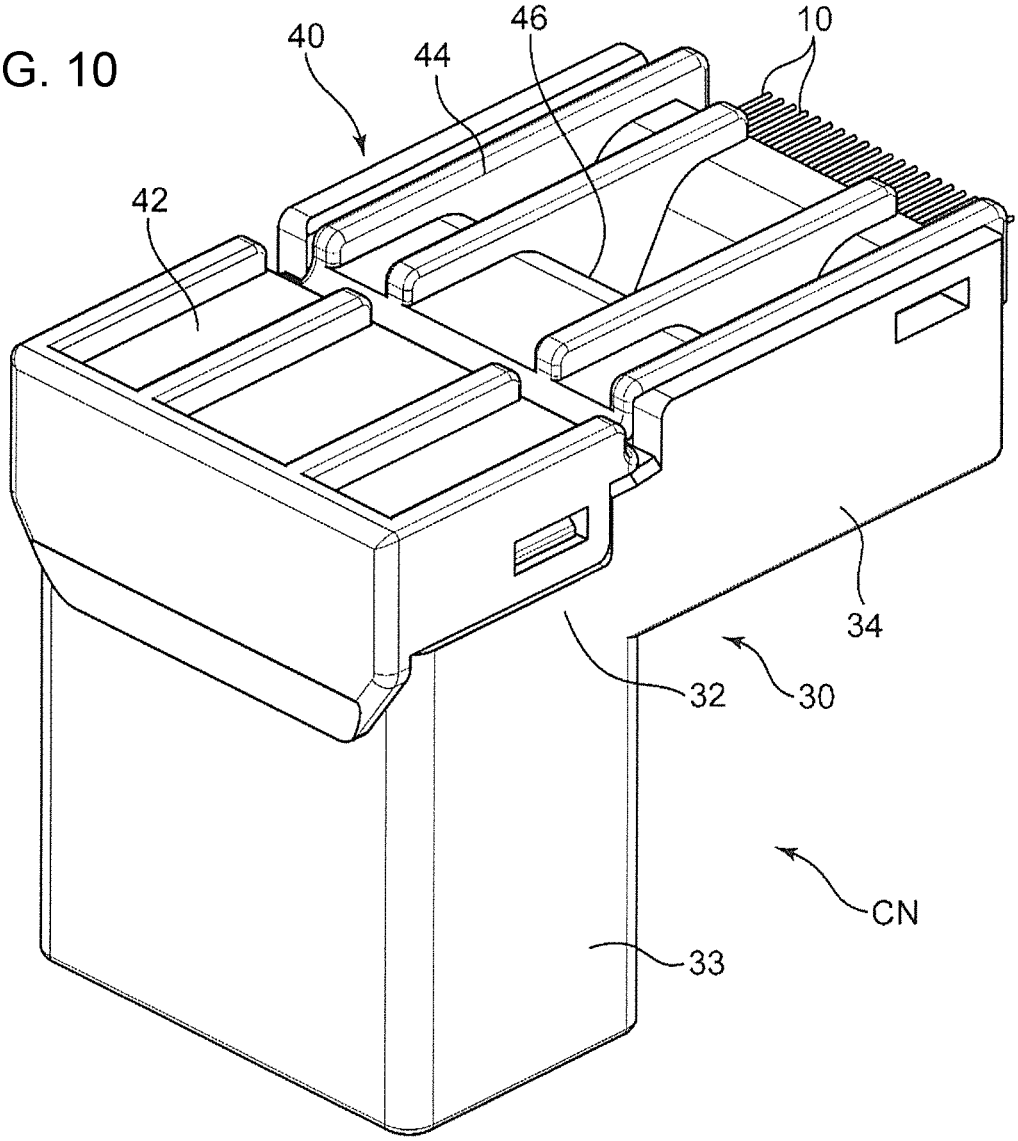
FIG. 10 is a perspective view showing a state where a cover is mounted on an insulating housing of the connector.
Figure 11:
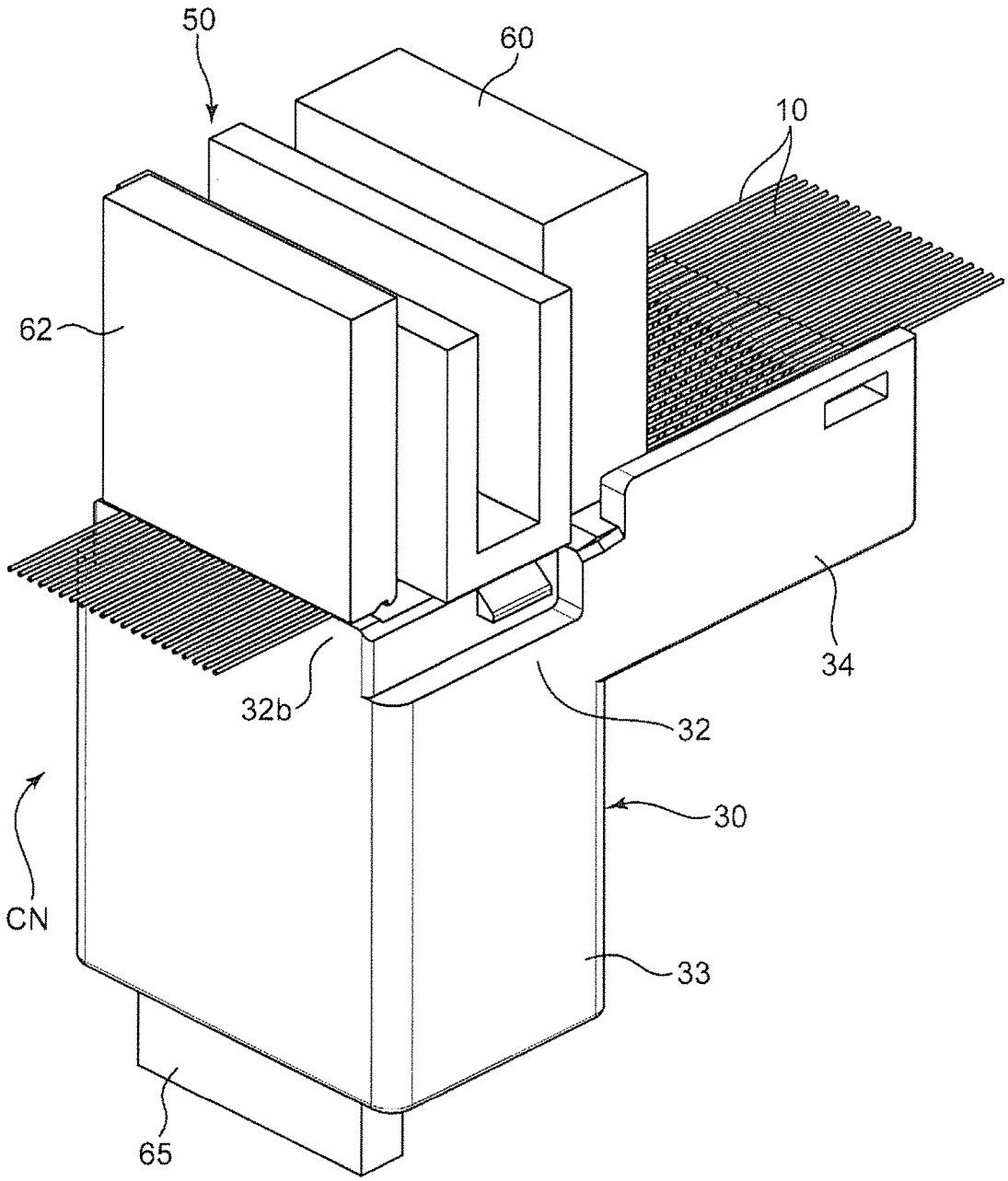
FIG. 11 is a perspective view showing a connecting step and a cutting step in a method for manufacturing an electrical connection assembly according to a second embodiment of the invention.

The connector CN according to the first embodiment further includes a cover 40 as shown in FIG. 10. The cover 40 is mounted detachably on the insulating housing 30 to cover the outward projecting portions 24 of the terminals 20 and the respective wires 10 connected to the outward projecting portions 24 from above. Specifically, the cover 40 according to the first embodiment integrally includes a terminal cover portion 42 for covering the terminal holding portion 32 and a wire cover portion 44 for covering the wire holding portion 34.

The upper surface of the wire holding portion 34 in the wire holding portion 34, i.e. a surface formed with the wire holding grooves 34*a*, has a curved portion 36 curved to be recessed down at an intermediate position in the second direction, whereas the lower surface of the wire cover portion 44 of the cover 40 has a curved portion 46 bulging down to correspond to the curved portion 36. The curved portions 46, 36 are shaped to restrain intermediate parts of the wires 10 with the intermediate parts curved down, thereby effectively suppressing the action of tension of the wires 10 at connected positions of the parts to be connected of the conductors 12 of the respective wires 10 and the conductor connection surfaces 27*a*.

Note that the wire holding portion 34 and the cover 40 are not essential in the invention and can be omitted. Conversely, if the parts to be connected are provided not near the ends of the wires 10, but at longitudinal intermediate parts, the wire holding portion 34 and the wire cover portion 44 of the cover 40 corresponding thereto may be provided on both sides of the terminal holding portion 32 in the longitudinal direction of the wires 10.

A method for manufacturing the electrical connection assembly includes the following steps.

Wire Preparing Step and Connector Preparing Step

The wires 10 and the connector CN described above are prepared in advance. Further, in the method according to this embodiment, the wires 10 prepared include the insulation coatings 14 made of a synthetic resin having an insulating property at normal temperature and being meltable or dissolvable at a melting temperature (e.g. 380 to 400°) of solder used in a connecting step to be described later. Polyurethane, polyester, nylon and the like are preferable as the specific synthetic resin.

A thickness of the insulation coating 14 preferably is set such that the insulation coating 14 can be removed and the conductor 12 can be exposed by heating while an insulating state is ensured at normal temperature. A dimension approximate to a thickness of an insulation coating in an ordinary enamel wire can be adopted as the thickness.

Solder Setting Step

Solder SD as shown in FIG. 6 is set in advance on the conductor connection surface 27*a* of each of the terminals 20 in the connector CN. This setting may be performed by placing the solder SD in a solid state on each conductor connection surface 27*a* or applying the solder SD in a paste state to each conductor connection surface 27*a*.

Connecting Step

Figure 1:
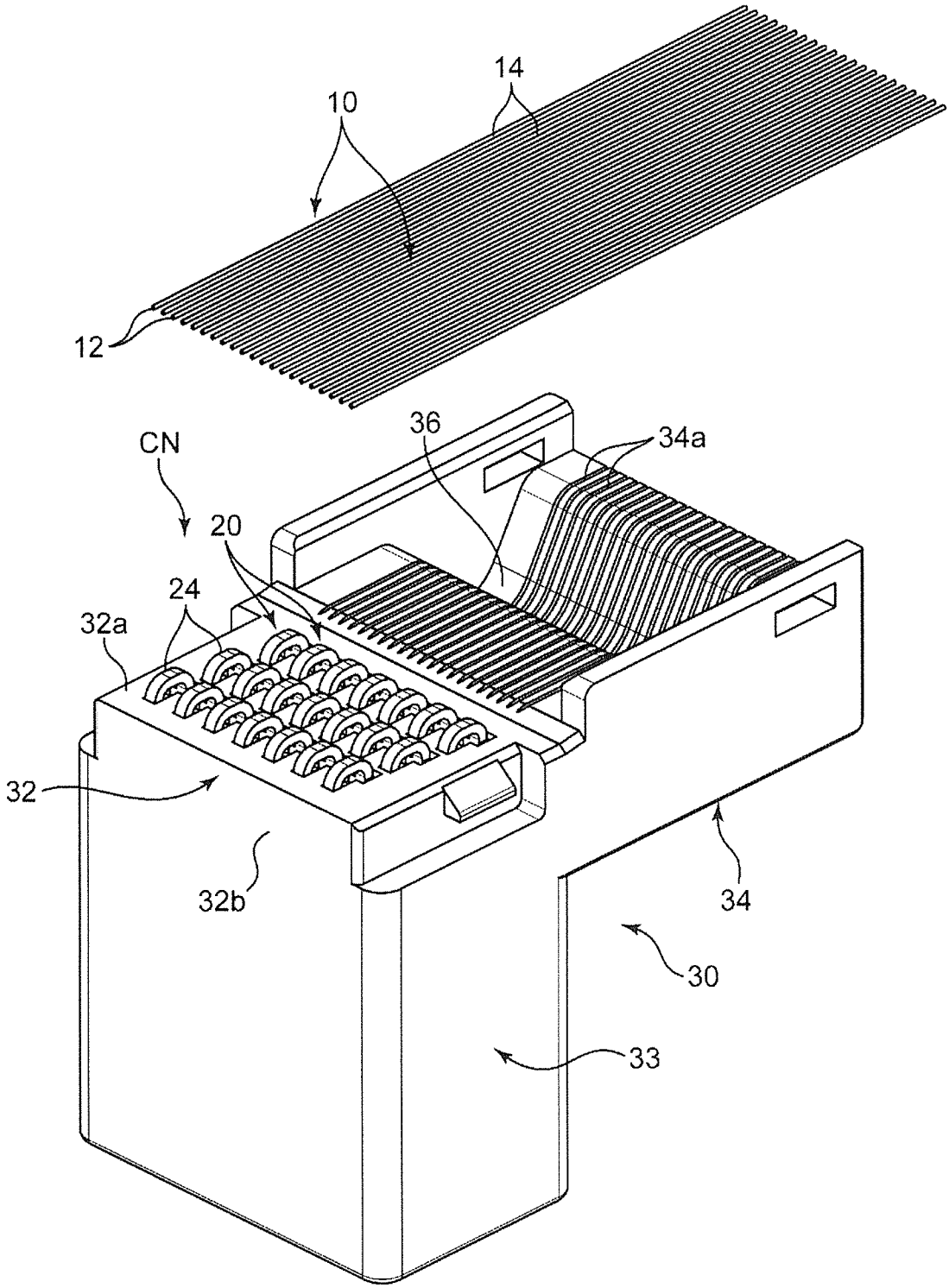
FIG. 1 is an exploded perspective view of an electrical connection assembly according to a first embodiment of the present invention.
Figure 2:
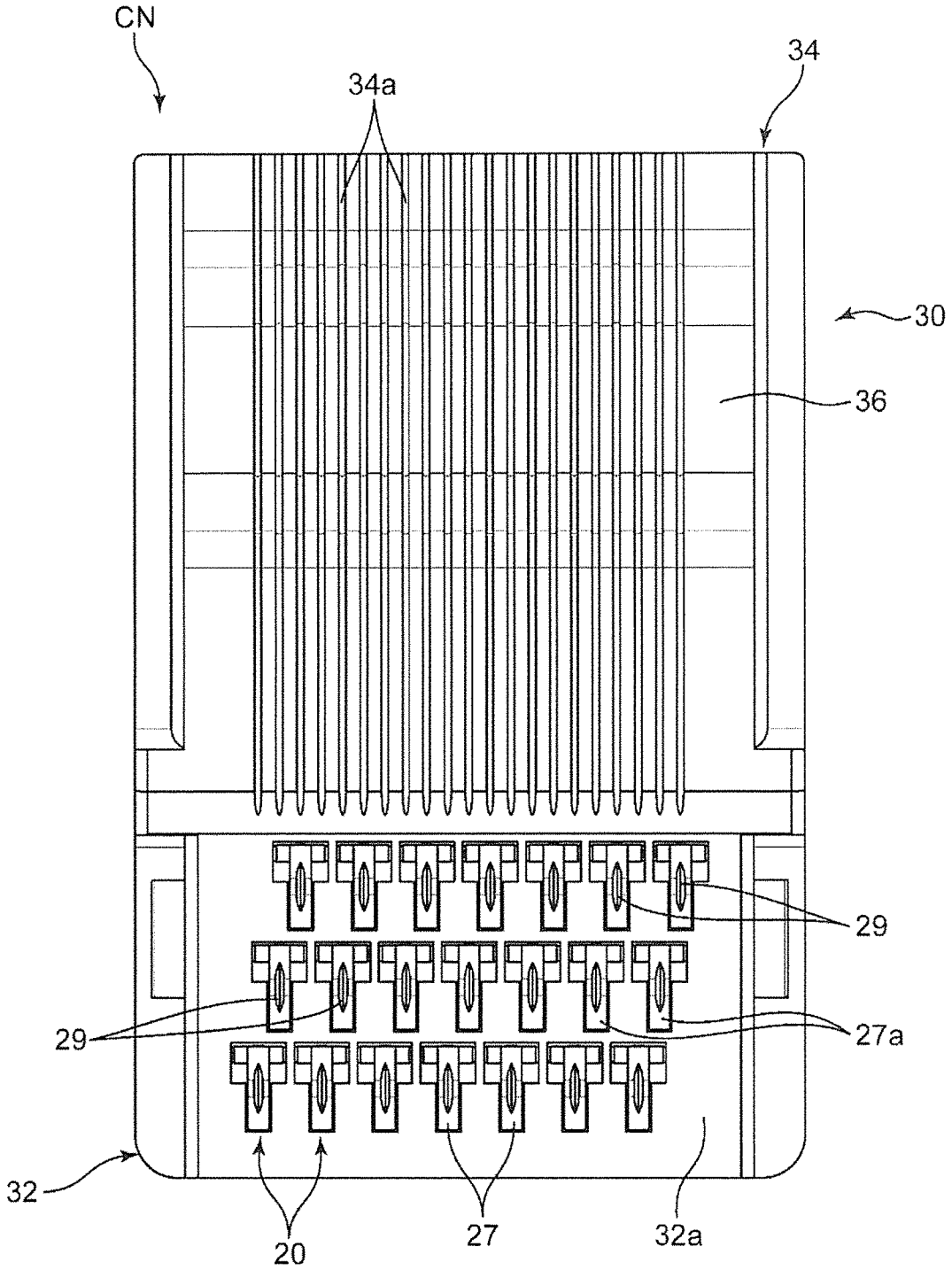
FIG. 2 is a plan view of a connector constituting the electrical connection assembly.
Figure 3:
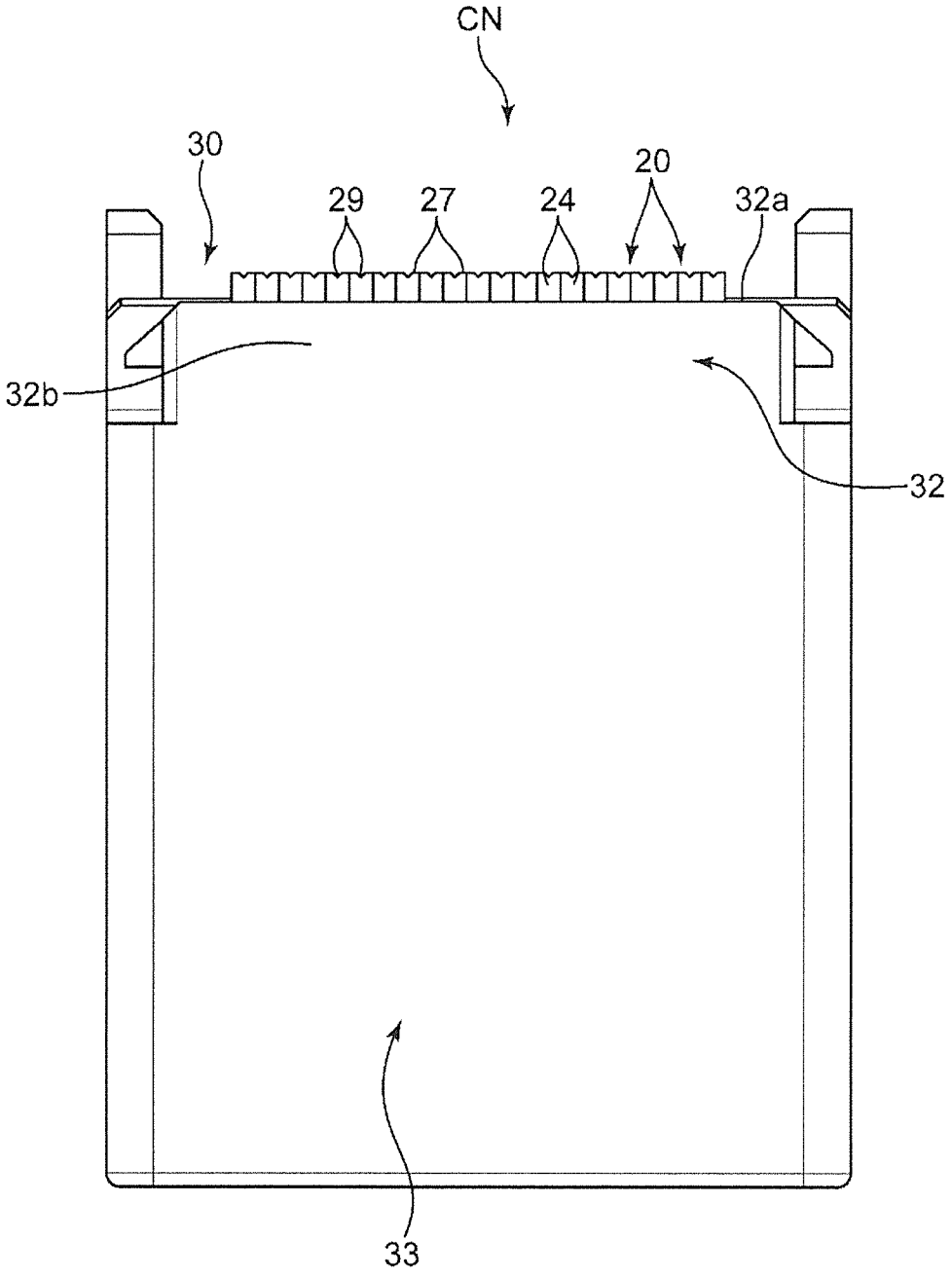
FIG. 3 is a front view of the connector.
Figure 4:
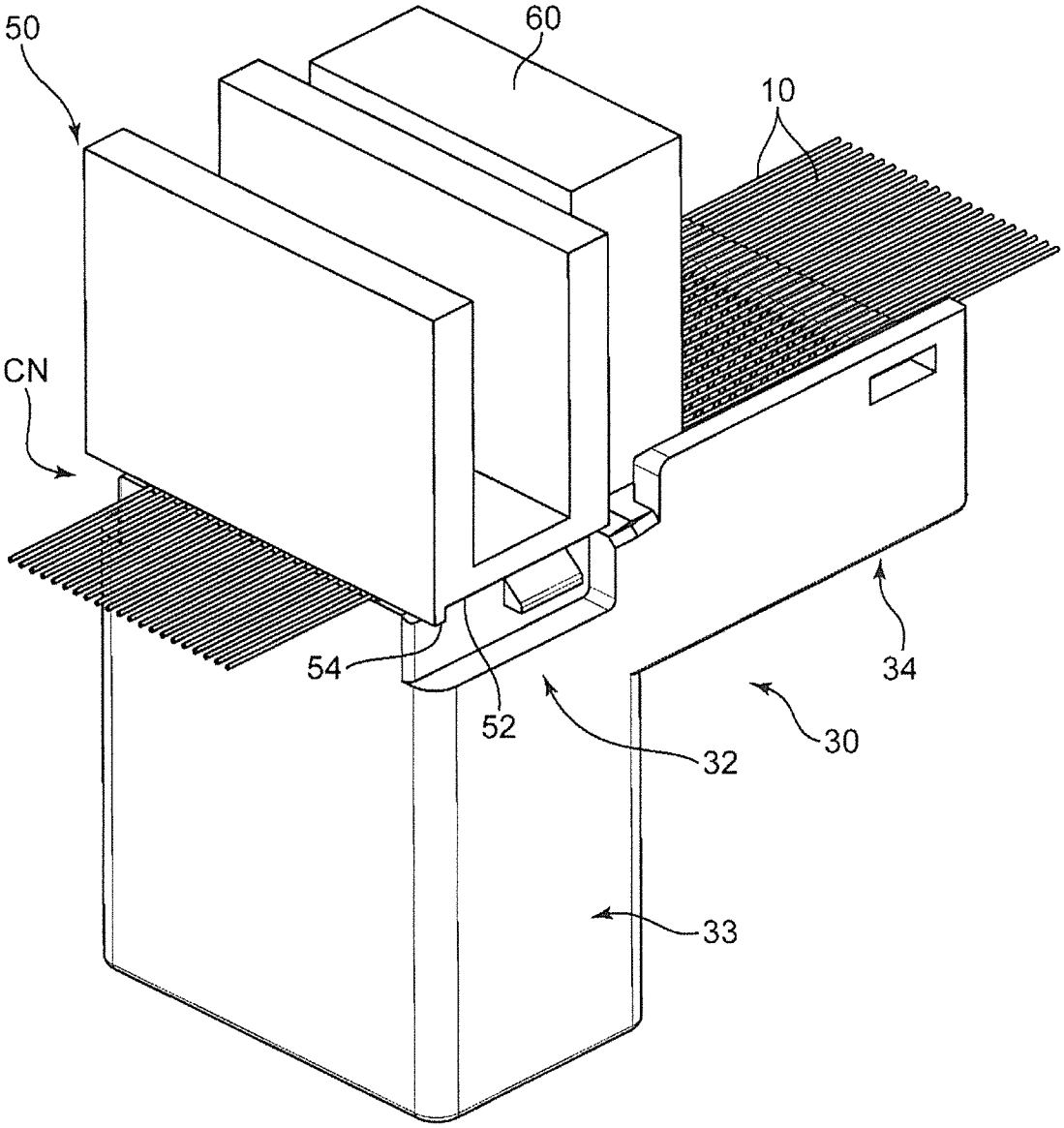
FIG. 4 is a perspective view showing a step of connecting conductor connection surfaces of terminals of the connector and parts to be connected of wires in a method for manufacturing the electrical connection assembly.

The parts of the conductors 12 that are to be connected are set in longitudinally intermediate areas of the plurality of wires 10 and are pressed toward the respective conductor connection surfaces 27*a* of the terminals 20. The parts that are to be connected are kept covered by the insulation coatings 14, and the insulation coatings 14 covering the parts to be connected are heated together with the solder SD while the wires 10 are held in a state arrayed at intervals from each other in the array direction as shown in FIG. 1. The insulation coatings 14 are removed from the surfaces of the conductors 12 by melting or dissolving, and the conductors 12 exposed by removing the insulation coatings 14 and the conductor connection surfaces 27*a* are connected electrically connected by the solder SD.

The wires 10 are held by holding parts of the wires 10 at positions on both outer sides across the parts to be connected, more preferably at positions outward of both ends of the connector CN in a front-rear direction (direction parallel to the second direction and the wire longitudinal direction). This holding applies suitable tension to the parts of the conductors 12 of the wires 10 that are set on the corresponding conductor connection surfaces 27*a*. The wires 10 can be held, for example, by bobbins on which the wires 10 are to be wound, clamping tools for clamping the respective wires 10 from both sides in a direction perpendicular to the longitudinal direction and the array direction of the wires 10 or the like.

Each conductor connection surface 27*a* of the first embodiment is formed with the groove 29, as shown in FIG. 7. Thus, a part of each wire 10 corresponding to the part to be connected of the conductor 12 is fit into the groove 29 and is held reliably at a suitable position on the conductor connection surface 27*a* (generally a center position in the width direction of the conductor connection surface 27*a*, i.e. in the array direction), thereby restricting an escape from this position in the array direction. Note that the solder SD set on the conductor connection surface 27*a* is not shown in FIG. 7 for the sake of convenience.

The wires 10 can be pressed efficiently against the conductor connection surfaces 27*a* and heated, using a heater 50, as shown in FIGS. 4 to 6, 8 and 9. This heater 50 has a flat lower surface constituting a heating surface 52. The heating surface 52 is pressed from above against the wires 10 set on the respective conductor connection surfaces 27*a* via the solder SD. That is, the heating surface 52 is pressed toward the conductor connection surfaces 27*a* with the wires 10 respectively corresponding to the conductor connection surfaces 27*a* and the solder SD sandwiched between the heating surface 52 and the respective conductor connection surfaces 27*a*. In this way, the pressing of the wires 10 toward the conductor connection surfaces 27*a*, the melting of the solder SD by heating using the heater 52 and the melting or dissolving of the insulation coatings 14 covering the parts to be connected by heating the insulation coatings 14 are performed simultaneously. The melting or dissolving of the insulation coatings 14 enables the insulation coatings 14 to be removed from the surfaces of the conductors 12.

In the first embodiment, the terminal holding portion 32 of the insulating housing 30 holds the terminals 20 such that the conductor connection surfaces 27*a* are arranged on the same plane, i.e. the respective terminals 20 constitute the planar array of terminals. Thus, the single planar heating surface 52 simultaneously connects the connection parts of the conductors 12 of the respective wires 10 to the planar array of the conductor connection surfaces 27*a* of the respective terminals 20.

In addition, each conductor connection surface 27*a* is provided on the outward projecting portion 24 of each terminal 20 projecting outward (up in FIG. 6) from the upper surface 32*a* of the terminal holding portion 32 and is located at the position separated out from the upper surface 32*a*. More particularly, in this embodiment, the conductor connection surface 27*a* is constituted by the outer side surface of the second projecting portion 27 having the inner side surface 27*b* located at a position separated from the upper surface 32*a*. Thus, short circuits between the terminals 20 and short circuits between the wires 10 associated with the melting of the solder SD and the melting and removal of the insulation coatings 14 are prevented. Thus, even if the solder SD is set, for example, in such a manner that the solid solder SD spreads across the of terminals 20, the solder SD is naturally divided for each terminal 20 by the surface tension of the solder SD by being heated as described above so that a short circuit via the solder SD is prevented.

In this connecting step according to the first embodiment, the wire 10 preferably is pressed toward the surface of the insulating housing 30 (preferably, the upper surface 32*a* of the terminal holding portion 32) at positions on both sides across the outward projecting portion 24 of the terminal 20, thereby deforming the wire 10 into an outward convex shape at the outward projecting portion 24, as shown in FIG. 6. In an example shown in FIGS. 4 to 6, the wire 10 is deformed by the cooperation of a pressing portion 54 provided in advance in the heater 50 and projecting farther out than the heating surface 52 and a pressing member 60 prepared separately from the heater 50.

Such pressing of the wire 10 reliably fixes a relative position of the part to be connected with respect to the conductor connection surface 27*a* and suppresses the removal of the insulation coating 14 in parts other than the part to be connected due to the heating of these parts by the heater 50. In this way, a short circuit between the wires 10 due to the removal of the insulation coatings 14 is prevented.

Cutting Step

After the connecting step is completed as described above, the wires 10 are cut at a suitable position in the longitudinal direction thereof. The wires 10 can be cut efficiently by sandwiching and shearing the wires 10 at a suitable cutting position in a cutting direction perpendicular to the longitudinal direction and the array direction of the wires 10 by two cutting tools 62, 63, as indicated by chain double-dashed line in FIG. 5. Each of the cutting tools 62, 63 includes a cutting blade 62*c*, 63*c*. The cutting blades 62*c*, 63*c* project toward the mating cutting tools at positions adjacent to each other in the longitudinal direction of the wires 10 and sandwich the wires 10 in the cutting direction to apply a shear force, thereby simultaneously cutting the wires 10 at the cutting position.

The cutting position is set in an area between one holding position and the parts to be connected. The cutting position shown in FIG. 6 is on a side opposite to the wire holding portion 34 across the terminal holding portion 32 and immediately proximate to an outer side surface 32*b* of the terminal holding portion 32. By cutting the wires 10 at such a cutting position, the ends of the wires 10 can be disposed near the outer side surface 32*b* of the terminal holding portion 32.

This cutting step preferably is performed with the wires 10 kept pressed against the upper surface 32*a* of the terminal holding portion 32 in the connecting step, i.e. with the wires 10 kept pressed against the surface of the insulating housing 30 at a position between the parts to be connected and the cutting position. This pressing ensures that the action of an external force (shear force) applied to each wire 10 for the cutting does not impose a large tensile load on each solder connected part. Thus, connection reliability can be enhanced.

The electrical connection assembly is completed by mounting the cover 40 as shown in FIG. 10, if necessary after, the cutting step is performed.

Although the cutting position shown in FIG. 5 is immediately outward of the outer side surface 32*b* of the terminal holding portion 32 of the insulating housing 30 in the connector CN, a cutting position according to the invention is more preferably set at a position inward of an outer side surface of a connector. Cutting at this cutting position facilitates the protection of the ends of the wires by locating the ends of the wires formed by the cutting inward of a connector outer edge.

However, if the cutting position is inward of the outer surface of the insulating housing, the cutting easily is accompanied by interference of the cutting tools and the insulating housing, and the interference makes it difficult to cut the wires.

Accordingly, each of connectors CN according to second and third embodiments described below is shaped to receive the entrance of at least one of a pair of cutting tools at a position inward of an outer side surface of the connector CN and enclose a cutting tool path for allowing the cutting tool to move in the cutting direction. Accordingly, the wires can be cut at the position inward of the outer side surface of the insulating housing with the cutting tool located in the cutting tool path while the interference of the cutting tool and the connector is avoided.

FIGS. 11 to 14 show the connector CN according to the second embodiment. An insulating housing 30 of this connector CN includes a terminal holding portion 32, a receptacle 33 and a wire holding portion 34 similar to the insulating housing 30 according to the first embodiment and, in addition, the terminal holding portion 32 is formed with a through hole 35 penetrating through the terminal holding portion 32 in the cutting direction. The through hole 35 and a space located right below the through hole 35 constitute the cutting tool path, and a lower cutting tool 65 is vertically insertable into the cutting tool path.

An upper cutting tool 62 has a cutting blade 62*a* projecting downward. The cutting blade 62*a* has a lower surface that is shaped to press parts of the wires 10 outwardly of the outward projecting portions 24 during a connecting step using a heater 50 as in the first embodiment. That is, the upper cutting tool 62 can also function as a wire pressing member.

Figure 12:
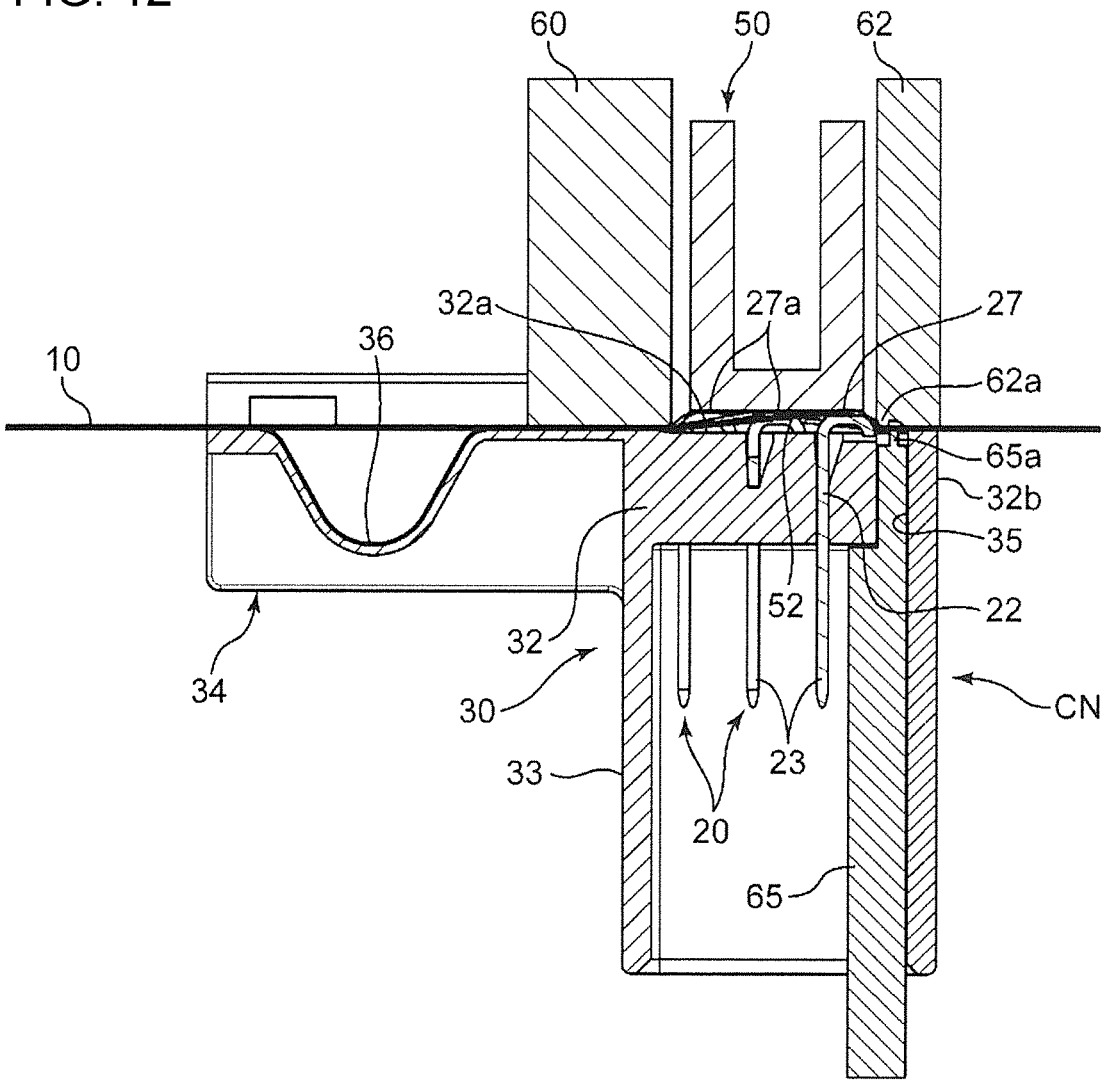
FIG. 12 is a side view in section showing the connecting step and the cutting step in the for manufacturing an electrical connection assembly according to the second embodiment of the present invention.
Figure 13:
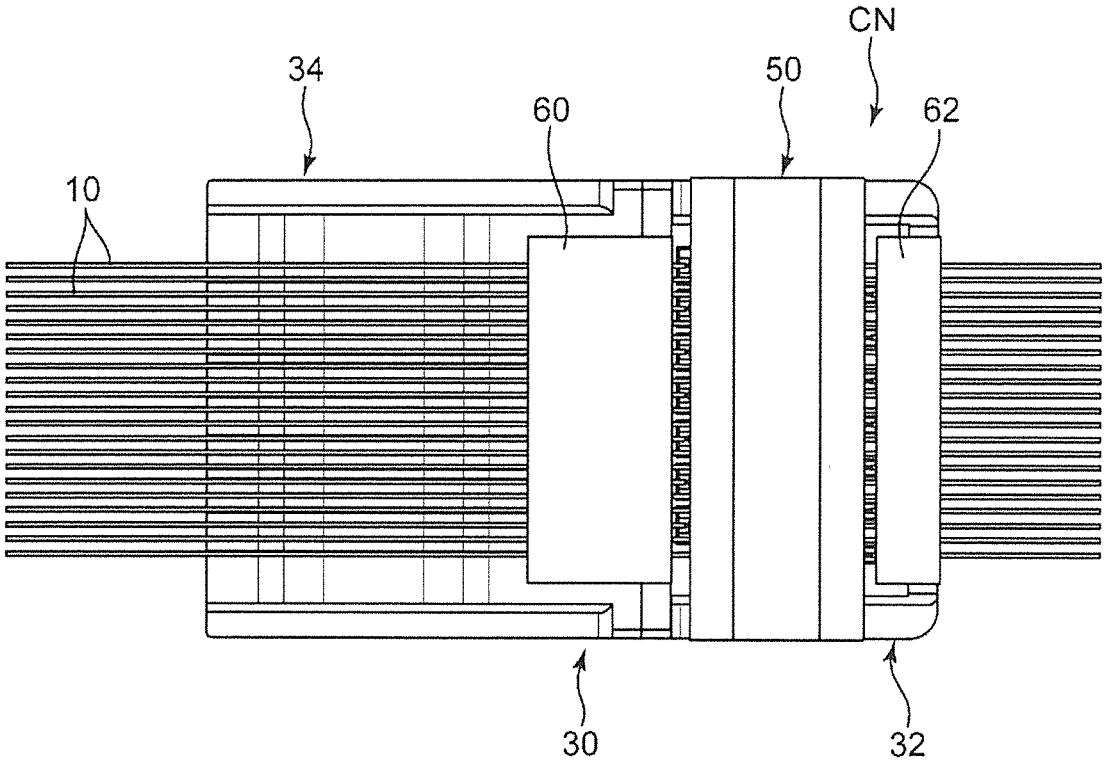
FIG. 13 is a plan view showing the connecting step and the cutting step in the for manufacturing an electrical connection assembly according to the second embodiment of the present invention.
Figure 14:
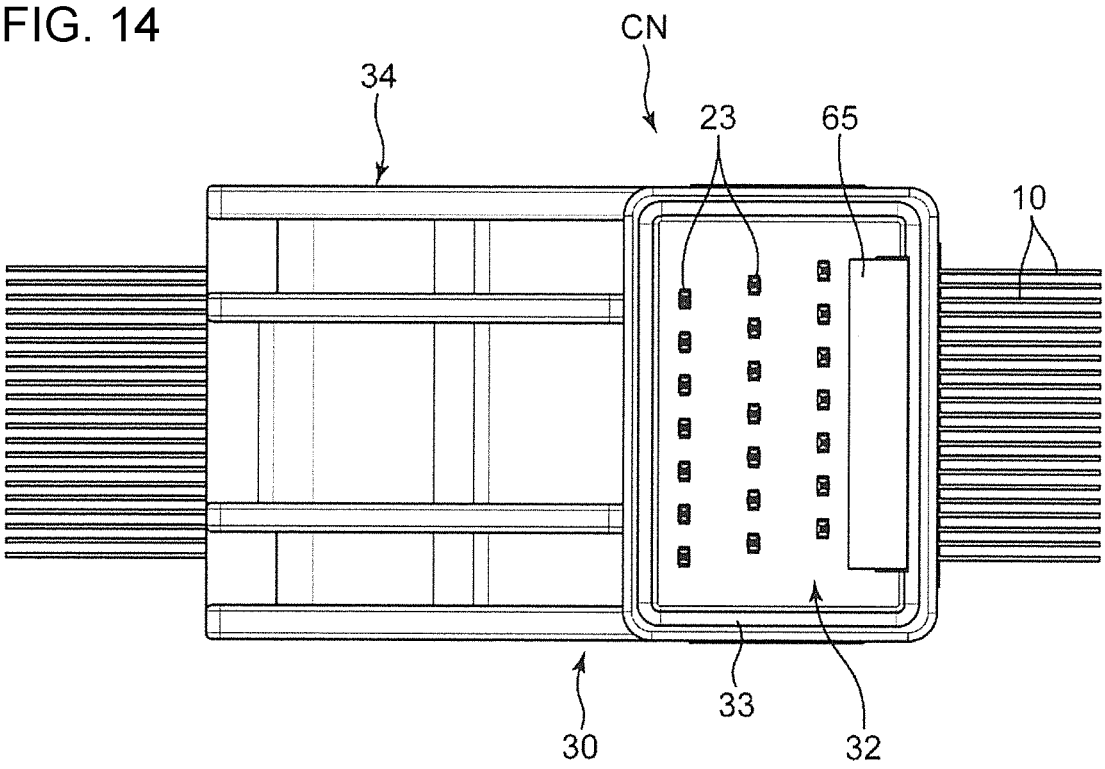
FIG. 14 is a bottom view showing the connecting step and the cutting step in the for manufacturing an electrical connection assembly according to the second embodiment of the present invention.
Figure 15:
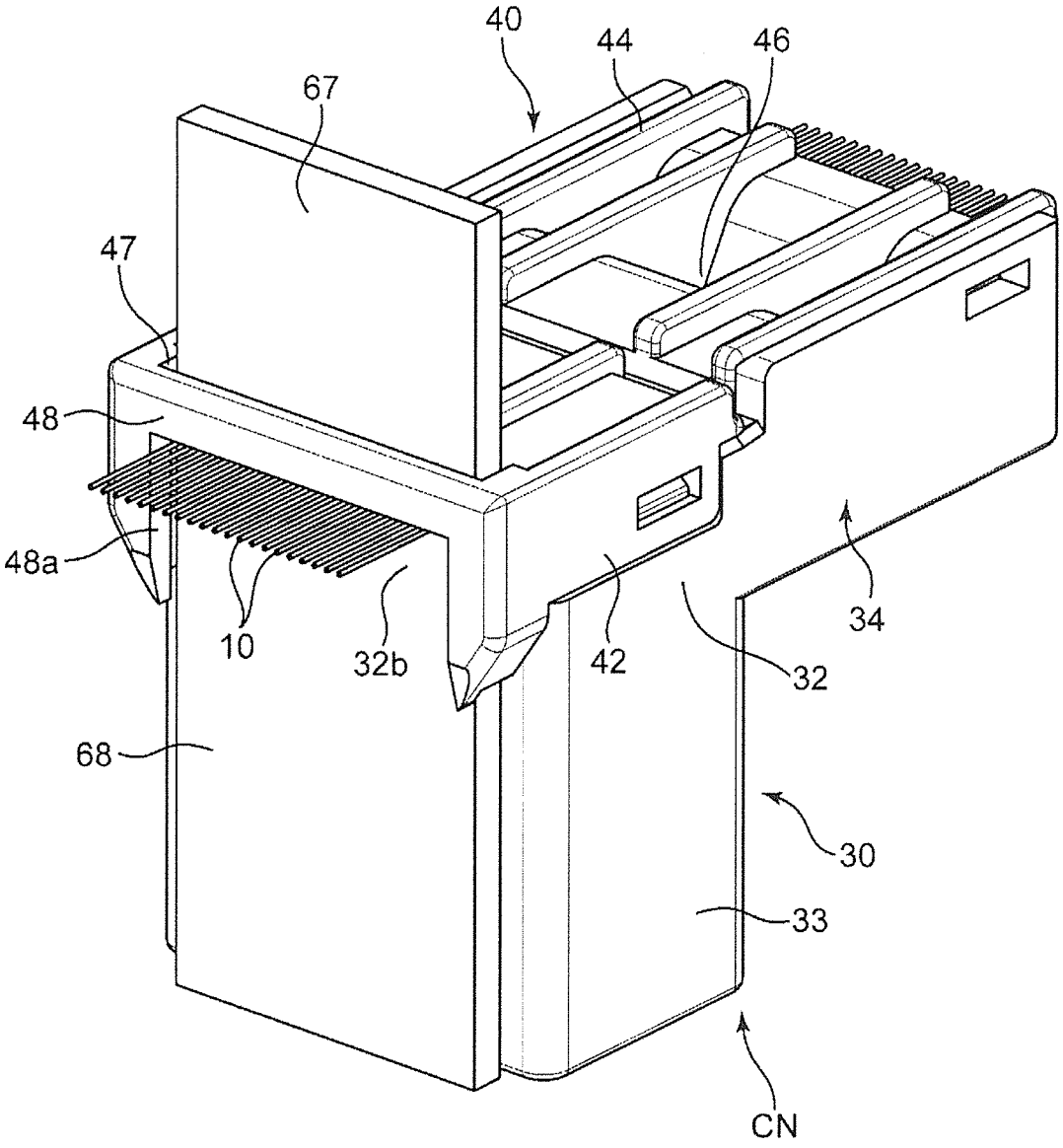
FIG. 15 is a perspective view showing a connecting step and a cutting step in a method for manufacturing an electrical connection assembly according to a third embodiment of the present invention.
Figure 16:
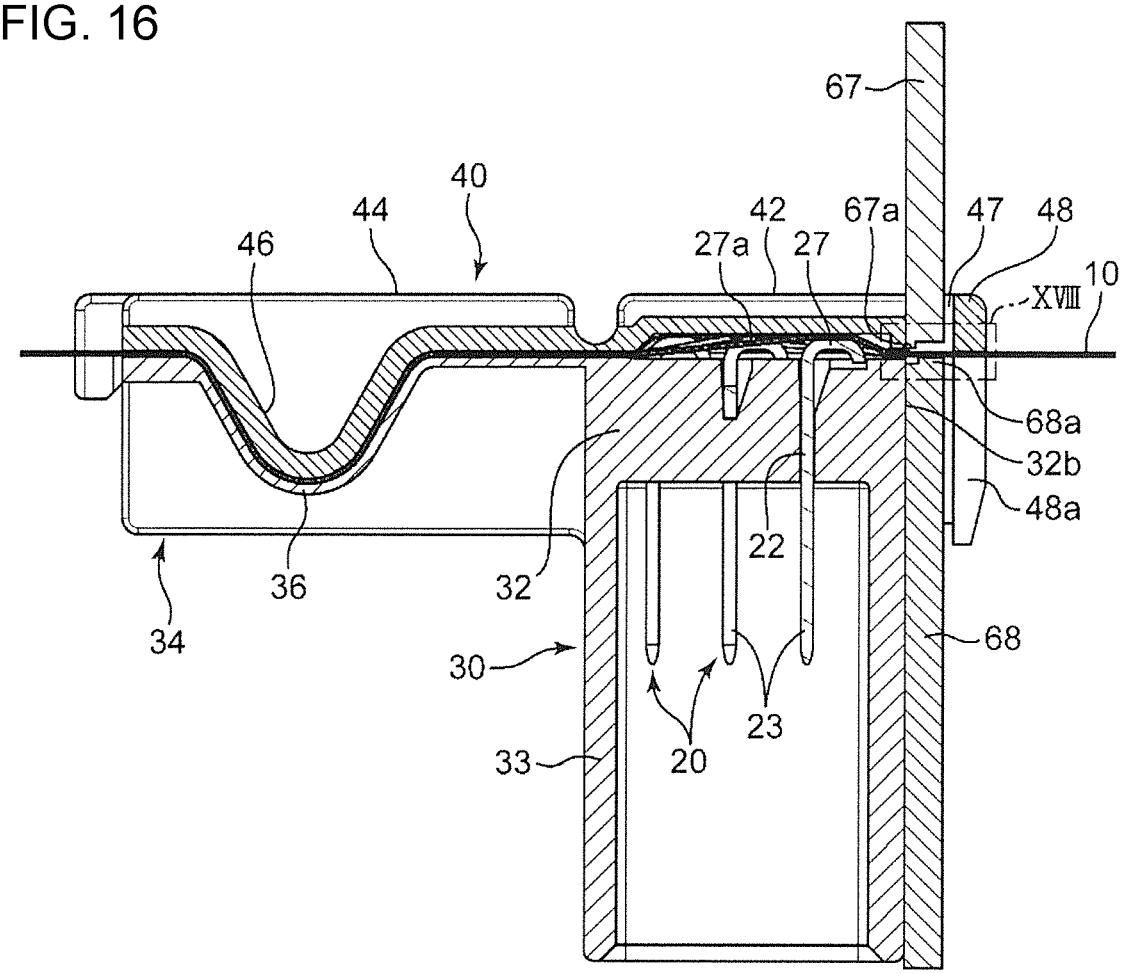
FIG. 16 a side view in section showing the connecting step and the cutting step in the for manufacturing an electrical connection assembly according to the third embodiment of the present invention.
Figure 17:
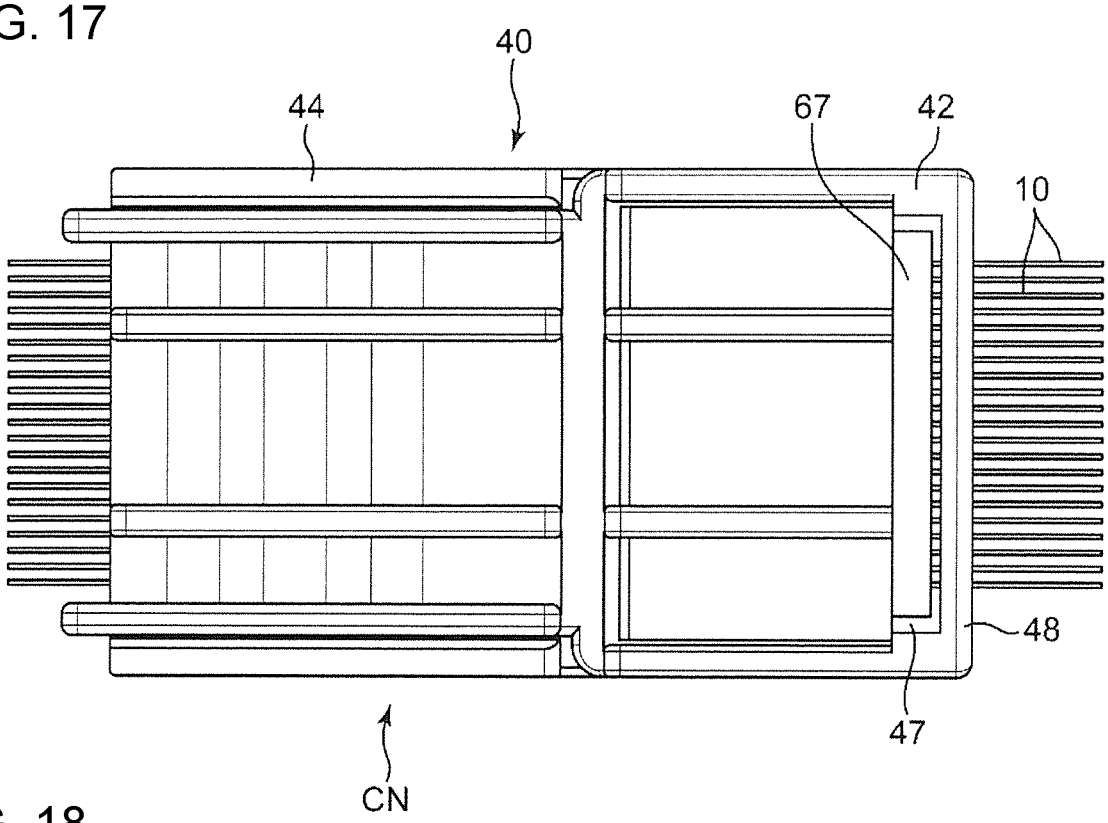
FIG. 17 is a plan view showing the connecting step and the cutting step in the for manufacturing an electrical connection assembly according to the third embodiment of the present invention.
Figure 18:
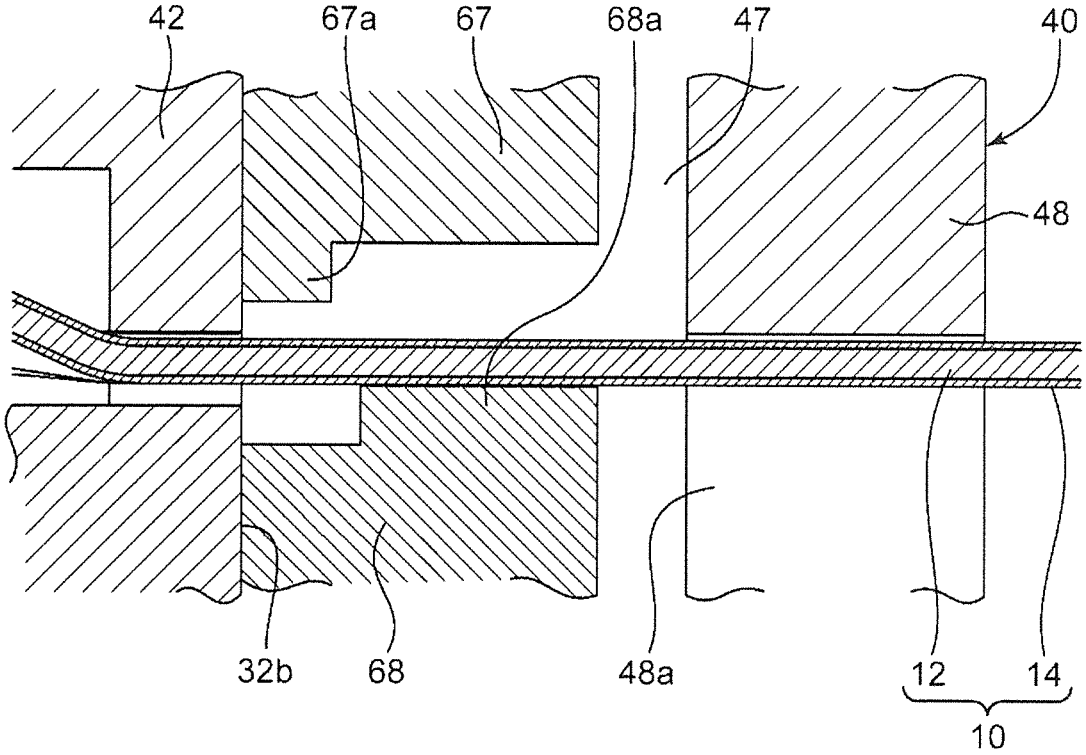
FIG. 18 is an enlarged view of an area enclosed by a frame line XVIII in FIG. 16.

On the other hand, as shown in FIG. 12, the lower cutting tool 65 includes a first insertion part insertable into the through hole 35 and a second insertion part having a larger thickness than the first insertion part and arranged in an internal space of the receptacle 33, and a cutting blade 65*a* projects up from the upper surface of the first insertion part. This cutting blade 65*a* projects at a position adjacent to the cutting blade 62*a* in a direction parallel to the longitudinal direction of the wires 10.

According to the connector CN and the cutting tools 62, 65, a shear force can be applied to each of the wires 10 by the cutting blade 65*a* of the cutting tool 65 and the cutting blade 62*a* of the upper cutting tool 62 by moving the lower cutting tool 65 up in the cutting tool path with the upper cutting tool 62 held at the same position after a cutting step is performed as in the first embodiment using the heater 50 while the wires 10 are pressed against an upper surface 32*a* of the terminal holding portion 32 using the upper cutting tool 62. In this way, all of the wires 10 can be cut at once at the cutting position inward (left in FIG. 12) of an outer side surface (right side surface in FIG. 12) 32*b* of the terminal holding portion 32.

FIGS. 15 to 18 show the connector CN according to the third embodiment. This connector CN includes a cover 40A in addition to terminals 20 and an insulating housing 30 similar to the terminals 20 and the insulating housing 30 of the first embodiment.

The cover 40A includes a terminal cover portion 42 for covering a terminal holding portion 32 of the insulating housing 30 and a wire cover portion 44 for covering a wire holding portion 34, similar to the cover 40 shown in FIG. 10. The cover 40A also has a bulging part 48 bulging farther out (right in FIGS. 16 and 18) from an outer side surface 32*b* of the terminal holding portion 32. This bulging part 48 is formed with a cutout 48*a* for allowing the insertion of the wires 10.

The bulging part 48 is formed with a through hole 47 constituting the cutting tool path as a feature of this cover 40A. Specifically, this through hole 47 vertically penetrates through the bulging part 48 to allow an upper cutting tool 67 (of upper and lower cutting tools 67, 68) used in a cutting step, to be inserted vertically.

The upper cutting tool 67 includes a cutting blade 67*a* projecting down similar to the cutting tool 62 of the second embodiment, and the lower cutting tool 68 includes a cutting blade 68*a* projecting up at a position adjacent to the cutting blade 67*a* in a direction parallel to the longitudinal direction of the wires 10, similar to the cutting tool 65 of the second embodiment.

According to the connector CN of the third embodiment, the wires 10 can be cut at once at a cutting position inward of an outer side surface of the bulging part 48 of the cover 40A by the cutting blade 67*a* of the upper cutting tool 67 and the cutting blade 68*a* of the lower cutting tool 68 with the upper cutting tool 67 inserted in the through hole 47 of the cover 40A after the cover 40A is mounted on the insulating housing 30, following a connecting step performed as in the first and second embodiments. Thus, the ends of the wires 10 formed by cutting in this cutting step can be protected by being directly accommodated inside the cover 40A.

The invention is not limited to the embodiments described above and may includes the following modes.

A) Concerning Wiring Material

The wiring material used in the present invention is not limited to the one in which the conductors 12 are covered individually by the insulation coatings 14 to configure the wires 10 as described above. The wiring material may be such that an insulation coating covering respective conductors adjacent to each other in the array direction is an integrally connected insulation coating, e.g. a flat cable or a ribbon cable. Alternatively, a wiring material may be constituted by a plurality of bare wires including no insulation coating.

B) Concerning Terminal

The specific shape of the terminal according to the invention is not limited. The terminal may have the conductor connection surface exposed outside the insulating housing and may have the part to be connected of the conductor connected to the conductor connection surface. For example, each terminal 20 may be held in the terminal holding portion 32 such that only the second projecting portion 27 of the outward projecting portion 24 according to the first embodiment projects out from the upper surface 32*a* of the terminal holding portion 32 and the outer side surface (conductor connection surface 27*a*) of the second projecting portion 27 is exposed. Alternatively, if a cross-sectional area (area of a cross-section perpendicular to an axial direction) of the terminal is relatively large, an end surface of this terminal may be used directly as a conductor connection surface.

C) Connecting Step

The removal of the insulation coatings 14 from the surfaces of the conductors 12 by melting or dissolving is performed simultaneously with the melting of the solder by heating using the heater in each of the above embodiments. However, the insulation coatings 14 may be removed before heating. Specifically, the insulation coatings may be removed in advance before the connecting step by a so-called stripping process to expose the parts to be connected in the conductors, and the conductors exposed as described above and the conductor connection surfaces may be soldered in the connecting step. In this case, the material constituting the insulation coatings may not necessarily be meltable or dissolvable at the melting temperature of the solder. Further, the removal of the insulation coatings is not necessary if the wiring material is constituted by a plurality of bare wires.

Further, a specific means for the connection is not limited to soldering. This connection may be made by another connecting means by heating such as welding (laser welding, ultrasonic welding, resistance welding or the like).

D) Concerning Cutting Position

The cutting position set in the cutting step is not limited to the position near the outer side surface of the connector. For example, if the connector CN is connected to intermediate parts of the wires 10 (like a connector for branch connection), the cutting position is set at a position separated from the parts of the conductors to be connected by a distance corresponding to a length determined for the wiring material, i.e. at a position separated from the outer side surface of the connector CN by a large distance.

In other words, the parts of the wiring material to be connected in the electrical connection assembly, i.e. parts of the wiring material to be connected to the conductor connection surfaces of the connector, can be set arbitrarily set.

As described above, a method for manufacturing an electrical connection assembly with a wiring material including a plurality of conductors and a connector, the method being capable of ensuring high connection reliability by stabilizing relative positions of the conductors and terminals included in the connector, and a connector suitable for this method are provided.

A method is provided for manufacturing an electrical connection assembly with a wiring material including conductors and a connector including terminals respectively corresponding to the conductors and an insulating housing for collectively holding the terminals. The conductors are connected conductively to the terminals while being arranged in an array direction perpendicular to a longitudinal direction of the conductors. This method includes a connector preparing step of preparing a connector, in which each of the terminals has a conductor connection surface exposed outside the insulating housing from a surface of the insulating housing and the insulating housing holds the terminals such that the conductor connection surfaces are arranged in the array direction at the same intervals as those of the conductors in the array direction. The method also includes a connecting step of electrically connecting parts of the conductors of the wiring material located between holding positions separated from each other in a longitudinal direction of the wiring material and the conductor connection surfaces corresponding thereto by bringing these parts into contact with each other while applying tension to the wiring material by holding the wiring material at the holding positions with the conductors arrayed at intervals from each other in the array direction. The method further includes a cutting step of sandwiching the wiring material in a cutting direction perpendicular to each of the longitudinal direction of the wiring material and the array direction and cutting the wiring material by two cutting tools at a cutting position between one of the holding positions and the parts to be connected with the wiring material kept held after the completion of the connecting step.

According to this method, the connecting parts of the conductors of the wiring material located between the holding positions and the conductor connection surfaces corresponding thereto are connected with tension applied to the wiring material by holding the wiring material at the holding positions separated from each other in the longitudinal direction thereof in the connecting step. Relative positions of the parts of the conductors to be connected with respect to the conductor connection surfaces of the terminals can be made more stable as compared to a method for soldering ends of wires to terminals in a state where the ends of the wires are free end parts, i.e. no tension is applied, as before. By sandwiching and cutting the wiring material in the cutting direction perpendicular to each of the longitudinal direction of the wiring material and the array direction by the cutting tools at the cutting position set between the one holding position and the parts to be connected after the conductor connection surfaces and the parts to be connected are connected in this state. Thus, the electrical connection assembly in which the connector is connected at a desired position of the wiring material can be efficiently manufactured.

The connecting step and the cutting step preferably are performed with the wiring material pressed against a surface of the insulating housing between the parts of the conductors to be connected and the cutting position. This can enhance connection reliability by effectively suppressing the transfer of an external force for cutting applied to the wiring material in the cutting step to the parts to be connected.

In this method, the cutting position preferably is set at a position inward of an outer side surface of the connector. Cutting at the cutting position enables the end of the wiring material formed by the cutting to be located at the position inward of the outer side surface of the connector, thereby facilitating the protection of the end of the wiring material.

The connector preferably is shaped to receive the entrance of at least one of the cutting tools at the position inward of the outer surface of the connector and enclose a cutting tool path for permitting a movement of the cutting tool in the cutting direction in the connector preparing step, and the wiring material is cut with at least one of the cutting tools inserted in the cutting tool path. The use of this connector enables the wiring material to be cut easily at the position inward of the outer side surface of the connector while avoiding the interference of the cutting tool and the connector.

Further, a connector is provided which is suitable for the above method and constitutes an electrical connection assembly by being connected to a wiring material including plural conductors. This connector includes terminals respectively corresponding to the conductors and an insulating housing for collectively holding the terminals in such an array that the conductors are connectable conductively to the terminals while being arranged in an array direction perpendicular to a longitudinal direction of the conductors. Each of the terminals has a conductor connection surface exposed outside the insulating housing from a surface of the insulating housing and connectable to a part to be connected set in each conductor. The connector is shaped to receive the entrance of at least one of the cutting tools for cutting the wiring material at a position inwardly of an outer side surface of the connector and enclose a cutting tool path for permitting a movement of the cutting tool in a cutting direction perpendicular to each of a longitudinal direction of the wiring material and the array direction.

Each of the terminals includes a held portion to be held in the insulating housing of the connector and an electrical contact portion extending from the held portion to a side opposite to the conductor connection surface and shaped to fit to a mating terminal. The insulating housing includes a terminal holding portion for holding the held portions of the terminals and a receptacle integrally connected to the terminal holding portion and configured to surround the electrical contact portions of the terminals, and the cutting tool path is composed of a space enclosure by the receptacle and a through hole penetrating through the terminal holding portion in the cutting direction. In this connector, the cutting tool path composed of the through hole and the space inside the receptacle can be formed by a simple configuration of providing only the through hole in the terminal holding portion by effectively utilizing the space inside the receptacle.

If the connector further includes a cover to be mounted on the insulating housing to cover the parts to be connected, the cover may include a bulging part bulging farther out than an outer side surface of the insulating housing and this bulging part may be formed with a through hole constituting the cutting tool path. Also in this connector, the wiring material can be cut at the position inwardly of an outer side surface of the cover constituting the connector.

The invention claimed is:

1. A method for manufacturing an electrical connection assembly with a wiring material including conductors and a connector including terminals respectively corresponding to the conductors and an insulating housing for collectively holding the terminals, the conductors being respectively conductively connected to the terminals while being arranged in an array direction perpendicular to a longitudinal direction of the conductors, the method comprising:

a connector preparing step of preparing a connector, in which each of the terminals has a conductor connection surface exposed outside the insulating housing from a surface of the insulating housing and the insulating housing holds the terminals such that the conductor connection surfaces are arranged in the array direction at intervals corresponding to intervals of the conductors in the array direction;

a connecting step of electrically connecting parts of the conductors of the wiring material located between holding positions separated from each other in a longitudinal direction of the wiring material and the conductor connection surfaces corresponding thereto by bringing the parts of the conductors and the conductor connection surfaces into contact with each other while applying tension to the wiring material by holding the wiring material at the holding positions with the plurality of conductors arrayed at intervals from each other in the array direction; and a cutting step of sandwiching the wiring material in a cutting direction perpendicular to each of the longitudinal direction of the wiring material and the array direction and cutting the wiring material by two cutting tools at a cutting position between one of the holding positions and the parts to be connected with the wiring material kept held after completion of the connecting step.

2. The method for manufacturing an electrical connection assembly of claim 1, wherein the connecting step and the cutting step are performed with the wiring material pressed against a surface of the insulating housing between the parts of the conductors to be connected and the cutting position.

3. The method for manufacturing an electrical connection assembly of claim 2, wherein the cutting position is set at a position inwardly of an outer side surface of the connector.

4. The method for manufacturing an electrical connection assembly of claim 3, wherein the connector prepared is shaped to receive the entrance of at least one of the cutting tools at the position inwardly of the outer side surface of the connector and to enclose a cutting tool path for permitting a movement of the cutting tool in the cutting direction in the connector preparing step, and the wiring material is cut with at least one of the cutting tools inserted in the cutting tool path in the cutting step.

5. A connector of an electrical connection assembly that is connected to a wiring material including conductors, comprising:

terminals respectively corresponding to the conductors; and an insulating housing for collectively holding the terminals in an array such that the conductors are respectively conductively connectable to the terminals while being arranged in an array direction perpendicular to a longitudinal direction of the conductors;

each of the terminals having a conductor connection surface exposed outside the insulating housing from a surface of the insulating housing and connectable to a part to be connected set in each of the conductors, each of the terminals including a held portion to be held in the insulating housing and an electrical contact portion extending from the held portion to a side opposite to the conductor connection surface and shaped to fit to a mating terminal;

the insulating housing including a terminal holding portion for holding the held portions of the terminals and a receptacle integrally connected to the terminal holding portion and configured to surround the electrical contact portions of the terminals and the connector being shaped to receive the entrance of at least one cutting tool for cutting the wiring material at a position inwardly of an outer side surface of the connector and to enclose a cutting tool path for permitting a movement of the cutting tool in a cutting direction perpendicular to each of a longitudinal direction of the wiring material and the array direction, the cutting tool path being composed of a space enclosed by the receptacle and a through hole penetrating through the terminal holding portion in the cutting direction.

6. The connector of claim 5, further comprising a cover to be mounted on the insulating housing to cover the parts to be connected, the cover including a bulging part bulging farther outward than an outer side surface of the insulating housing, the bulging part being formed with a through hole constituting the cutting tool path.

* * * * *